US007537510B2

(12) United States Patent
Gransberry

(10) Patent No.: US 7,537,510 B2
(45) Date of Patent: May 26, 2009

(54) GARMENT HAVING DIG FREE STRAP

(75) Inventor: Leslie Ann Gransberry, Westport, CT (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 615 days.

(21) Appl. No.: 10/896,373

(22) Filed: Jul. 21, 2004

(65) Prior Publication Data

US 2006/0019577 A1 Jan. 26, 2006

(51) Int. Cl.
*A41D 3/00* (2006.01)

(52) U.S. Cl. ..... 450/86; 2/338; 2/268

(58) Field of Classification Search ..... 450/1, 450/86, 88; 2/267, 268, 336, 338, 327–332; 224/643, 264, 215, 202, 907, 155; 280/733, 280/751, 808; 150/107, 110; 297/482, 488
See application file for complete search history.

(56) References Cited

U.S. PATENT DOCUMENTS

| | | | | | |
|---|---|---|---|---|---|
| 2,568,670 | A | | 9/1951 | Traub | 2/325 |
| 3,291,132 | A | * | 12/1966 | Puliafico | 450/59 |
| 4,254,777 | A | | 3/1981 | Johnson | 128/465 |
| 4,292,975 | A | | 10/1981 | Champion | 128/498 |
| 4,314,569 | A | | 2/1982 | Speno | 128/425 |
| 4,795,399 | A | * | 1/1989 | Davis | 2/460 |
| 4,815,640 | A | | 3/1989 | Johnson | 224/202 |
| 4,953,233 | A | | 9/1990 | Moishier | 2/268 |
| 4,976,388 | A | | 12/1990 | Coontz | 224/264 |
| 5,129,564 | A | | 7/1992 | Danezin | 224/264 |
| 5,180,326 | A | * | 1/1993 | Williams | 450/91 |
| 5,240,159 | A | | 8/1993 | Gregory | 224/209 |
| 5,558,556 | A | * | 9/1996 | Froehlich | 450/86 |
| 5,637,026 | A | * | 6/1997 | Lakusiewicz | 450/86 |
| 5,803,792 | A | * | 9/1998 | Roush et al. | 450/86 |
| 5,873,767 | A | | 2/1999 | Pickett | 450/1 |
| 6,083,079 | A | | 7/2000 | Pearson | 450/1 |
| 6,135,852 | A | * | 10/2000 | Young | 450/86 |
| 6,165,045 | A | | 12/2000 | Miller | 450/1 |
| 6,168,498 | B1 | | 1/2001 | Wagner | 450/1 |
| 6,179,175 | B1 | | 1/2001 | Painter | 224/153 |
| 6,393,619 | B1 | * | 5/2002 | Bardes | 2/232 |
| 7,086,925 | B2 | * | 8/2006 | Kaye et al. | 450/58 |
| 2001/0019933 | A1 | | 9/2001 | Wagner | |

* cited by examiner

*Primary Examiner*—Gloria Hale
(74) *Attorney, Agent, or Firm*—Womble Carlyle Sandridge and Rice, PLLC

(57) ABSTRACT

A brassiere for protecting a wearer's skin has a pair of breast cups and a first side panel and a second side panel. Each is connected to a different one of the pair of breast cups. The brassiere also has a strap, and a length adjustment device being disposed on the strap. The brassiere also has a cushioning device. The cushioning device pads the wearer's skin from the length adjustment device. The cushioning device has a position stabilizing tab for preventing the cushioning device from sliding underneath the strap.

25 Claims, 8 Drawing Sheets

GARMENT HAVING DIG FREE STRAP

BACKGROUND OF THE INVENTION

1. Field of the Invention

The present invention relates to a garment. More particularly, the present invention relates to a brassiere or bra having a closure device, a length adjustment device in a shoulder portion of the brassiere and a cushioning device. The cushioning device pads a wearer's back and shoulder from a hardness of the length adjustment device.

2. Description of the Related Art

There exist in the art of brassieres, brassieres with an adjustment device on the shoulder straps. Often, the adjustment device is a strap assembly with a ring connected to a looped portion and a slide. The looped portion and the slide selectively adjust a length of each shoulder strap by sliding the slide relative to the looped portion on each shoulder strap. This operation selectively adjusts a length of each shoulder strap for fitting the brassiere on the wearer. Often, the adjustment device is made from durable and resilient members, such as a metal, steel, a thermoplastic, or any combinations thereof.

If these durable and resilient members contact the skin in the back and/or shoulder of the wearer, the resilient and durable members will rub or press against the wearer's back and/or the shoulder of the wearer. Any rubbing or pressing against the wearer's skin by the ring and slide or the strap assembly possibly could cause an uncomfortable sensation, such as redness and chafing of the skin.

Any attempt to cushion and place an intermediate layer therebetween may result in such an intermediate layer becoming caught between the shoulder straps of the brassiere or another structure. This would cause the intermediate layer to be out of position and rendered useless as the resilient and durable members once again will contact and rub and press against the wearer's back and/or shoulders. This entanglement may too cause an uncomfortable sensation and cause the user to remove the brassiere to adjust the intermediate layer. During strenuous activity, the user would be continuously adjusting the intermediate layer. This readjustment would, obviously result in an undesired operation of the brassiere.

Accordingly, there is a need for a garment that eliminates one or more of the aforementioned drawbacks and deficiencies of the prior art.

BRIEF SUMMARY OF THE INVENTION

It is an object of the present invention to provide a brassiere having a rear opening with a cushioned/padded strap assembly.

It is another object of the present invention to provide a brassiere having a rear opening with a rear closure device, an adjustment device, and a cushion/pad that cushions/pads a wearer's back and/or shoulders from the adjustment device.

It is still another object of the present invention to provide a brassiere having a pad that cushions a wearer's back and/or shoulders from an adjustment device and that does not slide relative to the adjustment device.

It is yet another object of the present invention to provide a brassiere with a cushion that has a position stabilizing tab.

It is a further object of the present invention to provide a brassiere that has a first cushion with a first position stabilizing tab that comprises a first longitudinal member and a second cushion with a second position stabilizing tab that has a second longitudinal member with the first longitudinal member connected to a first side panel and with the second longitudinal member connected to a second side panel.

It is still a further object of the present invention to provide a brassiere that has a cushion with a position stabilizing tab with the cushion being connected to a first strap.

It is yet a further object of the present invention to provide a brassiere that has a first cushion with a first position stabilizing tab that comprises a first longitudinal member and a second cushion with a second position stabilizing tab having a second longitudinal member with the first longitudinal member connected to a first side panel, the second longitudinal member being connected to a second side panel, and the first cushion being connected to a first strap by a number of lines of stitching and the second cushion also being connected to a second strap by a number of second lines of stitching.

It is still yet a further object of the present invention to provide a brassiere that has a first cushion with a first position stabilizing tab that has a first longitudinal member and a second cushion with a second position stabilizing tab with a second longitudinal member with the first longitudinal member anchored to a first side panel and the second longitudinal member anchored to a second side panel.

It is still another object of the present invention to provide a brassiere having a first cushion that cushions a wearer's shoulders from an adjustment device that is on a shoulder strap and that does not slide underneath the adjustment device or any shoulder strap.

It is still yet another object of the present invention to provide a brassiere with a first shoulder strap having a first adjustment device and a second shoulder strap having a second adjustment device with a cushioning device that cushions a wearer's shoulders from both the first adjustment device and the second adjustment device and that does not slide underneath either of the first shoulder strap or the second shoulder strap.

These and other objects and advantages of the present invention are achieved by a brassiere of the present invention. The brassiere is for protecting a wearer's skin and has a pair of breast cups, a first side panel and a second side panel. Each of the first side panel and the second side panel is connected to a different one of the pair of breast cups. The brassiere also has a strap and a length adjustment device being disposed on the strap. The brassiere also has a pad/cushioning device. The pad cushions the wearer's skin from the length adjustment device. The pad has a position stabilizing tab. The position stabilizing tab prevents the pad from sliding relative to the strap.

DETAILED DESCRIPTION OF THE INVENTION

Figure 1:
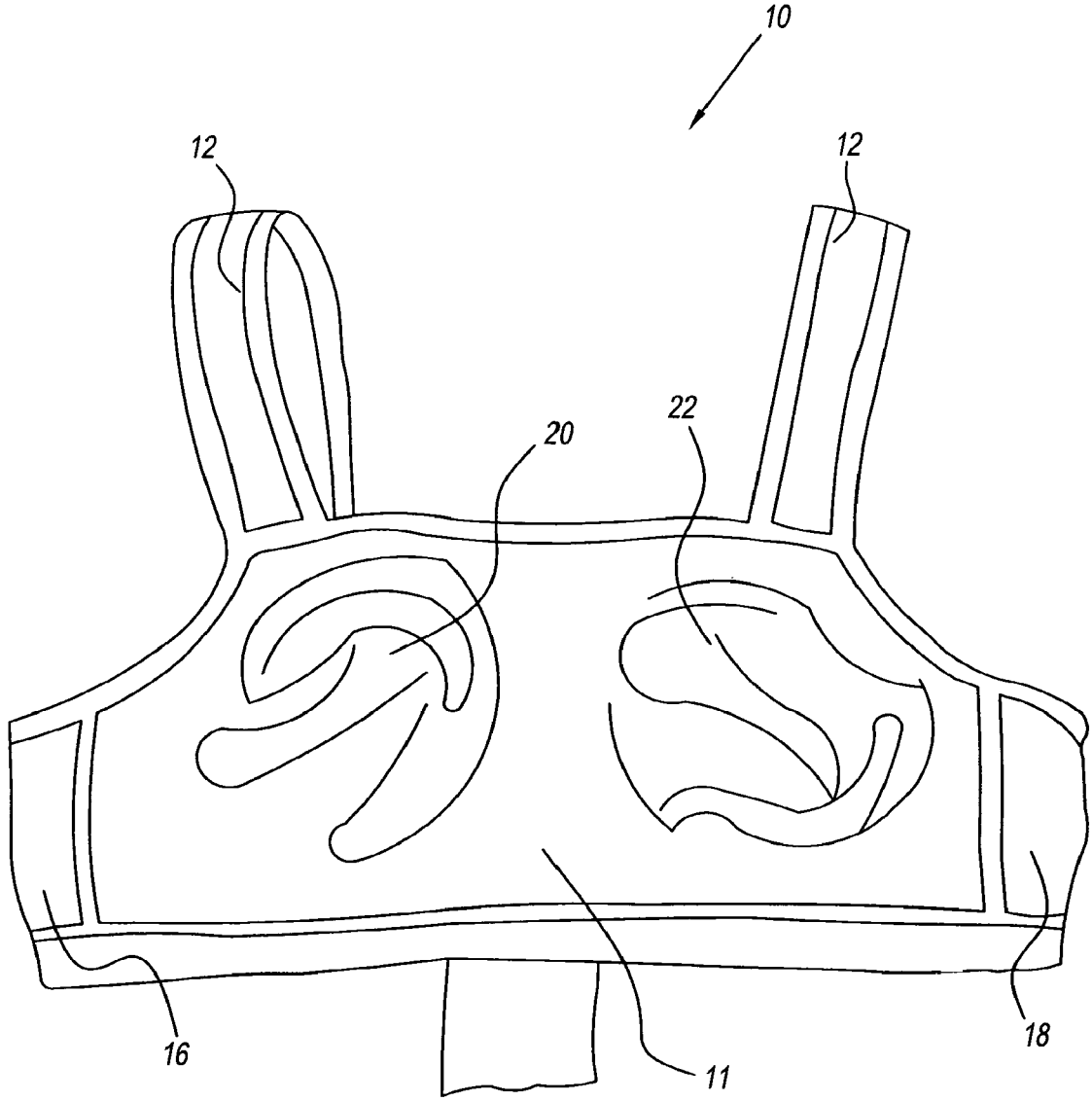
FIG. 1 is a front view of a brassiere in a closed position.

Referring to the drawings and, in particular, to FIG. 1, there is shown a brassiere of the present invention generally represented by reference numeral 10. Most preferably, the brassiere 10 provides a rear closure, and a shoulder length adjustment while simultaneously providing a cushion that pads the wearer's back and/or shoulder. The rear cushioning and the shoulder cushioning are most preferably anchored and maintained in position and do not slide underneath any structure of the bra during movement, for example, walking, running, or otherwise exercising.

The brassiere 10 preferably has a first front strap 12 and a second front strap 14. Both the first front strap 12 and the second front strap 14 are connected to a torso encircling structure or body 11, that for explanation purposes has a first side panel 16 and a second side panel 18. The brassiere 10 has a first breast cup 20 and a second breast cup 22 connected to the first side panel 16 and the second side panel 18, respectively. One skilled in the art should appreciate that the first and the second breast cups 20, 22 and the first and second side panels 16, 18 may be made from any suitable material known in the art and may be in any suitable size depending upon a wearer's geometry.

Figure 2:
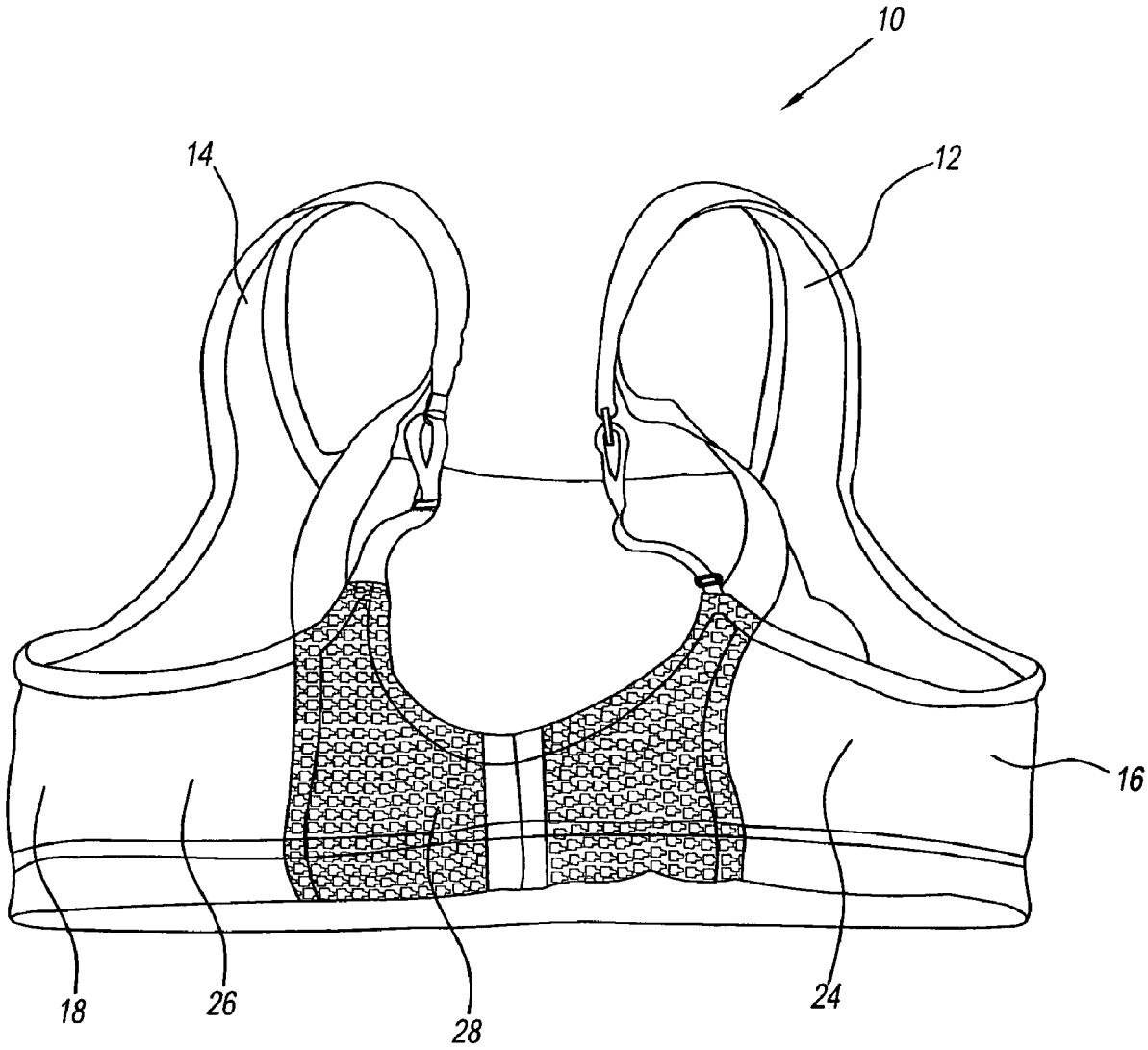
FIG. 2 is a rear view of the brassiere of FIG. 1 in a closed position.

Referring to FIG. 2, a rear of the brassiere 10 is shown (for illustration purposes) in a direction toward the wearer's back. The brassiere 10 has a first rear back panel 24 connected to the first side panel 16, and a second rear back panel 26 connected to the second side panel 18. The first rear back panel 24 and the second rear back panel 26 are both elastic straps. Alternatively, the first rear back panel 24 and the second rear back panel 26 may be one strap or a number of straps made from spandex, elastomeric yarns, a mesh, a webbing material or other inelastic materials such as nylon, cotton, silk, or any combinations thereof.

Figure 3:
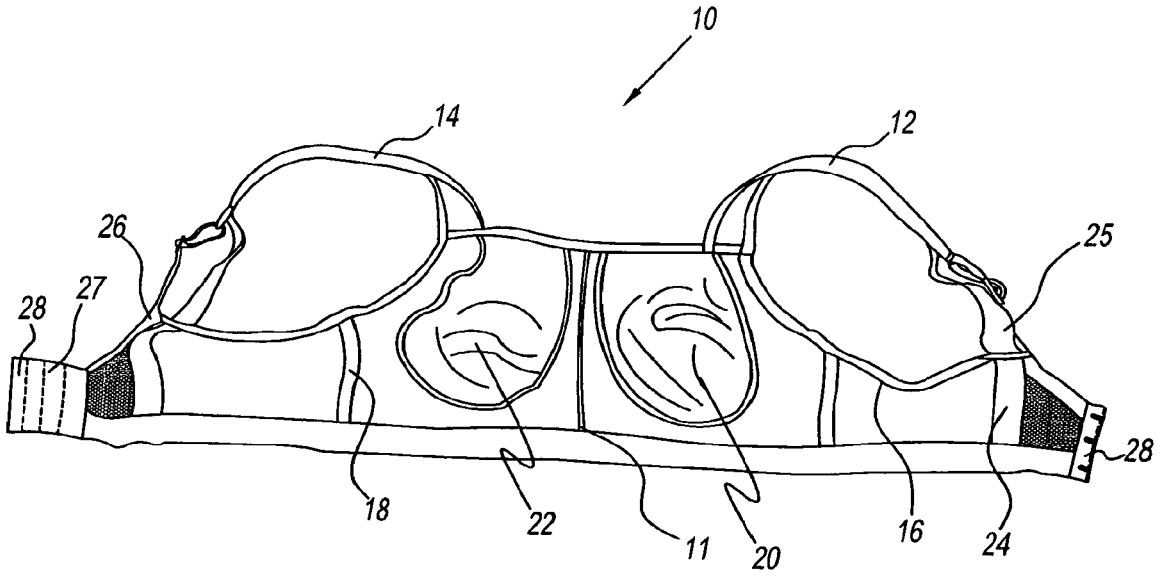
FIG. 3 is a rear view of the brassiere of FIG. 2 in an opened position.

The first rear back panel 24 and the second rear back panel 26 preferably connect to one another by a closure device, connection device, or preferably a hook and eye assembly 28. Preferably, the hook and eye assembly 28 is formed from a suitable resilient material, such as a thermoplastic or a metal, and is durable and capable of repeated usage. Alternatively, the first rear back panel 24 and the second rear back panel 26 may connect to one another by one or more hook and loop fasteners, one or more buttons, a number of clasps, a zipper, or any other closure device known in the art. Referring to FIG. 3, there is shown a rear of the brassiere 10 in an opened position. The hook and eye assembly 28 preferably allows the wearer to selectively open and selectively close the brassiere 10 in a comfortable and an easy manner. The hook portion of the hook and eye assembly 28 is preferably disposed on a hook tape 25 that is connected to the first rear back panel 24. Likewise, the eye portion of the hook and eye assembly 28 is preferably disposed on an eye tape 27 that is connected to the second rear back panel 26. One skilled in the art should appreciate that alternatively, the hook tape 25 may be connected to the second rear back panel 26 and the eye tape may be connected to the first rear back panel 24.

Figure 4:
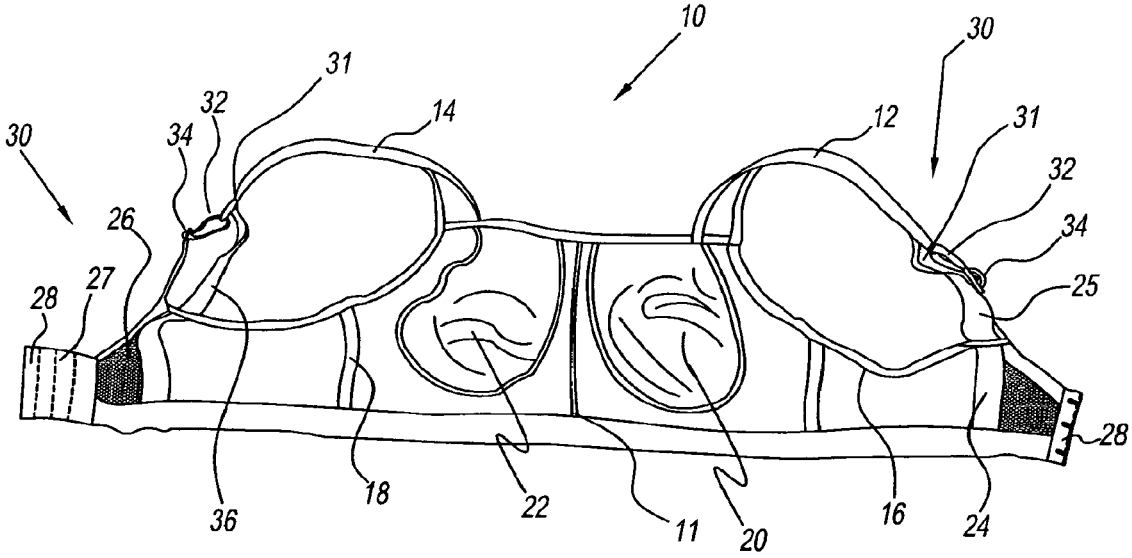
FIG. 4 is a rear view of the brassiere of FIG. 3 with a first front strap and a first cushioning device and a second front strap with a second cushioning device.

Referring to FIG. 4, there is shown another enlarged view of the rear of the brassiere 10 in the opened position with the first front strap 12 and the second front strap 14. The brassiere 10 further has a strap assembly 30 on each of the first front strap 12 and the second front strap 14. The strap assembly 30 preferably has a looped portion 32 connected to a ring 31 and a slide 34. The wearer may slide the looped portion 32 relative to the slide 34 to selectively adjust a length of the first front strap 12, the second front strap 14, or both the first and the second front straps. The slide 34 and the ring 31 of the strap assembly 30 are preferably each made from a durable and resilient member such as a thermoplastic, a metal, steel, or any combinations thereof. A known problem in the art is that the slide 34 and the ring 31 will press and dig into the wearer's back and/or shoulders. The brassiere 10 of the present invention preferably overcomes this known problem in the art.

Figure 5:
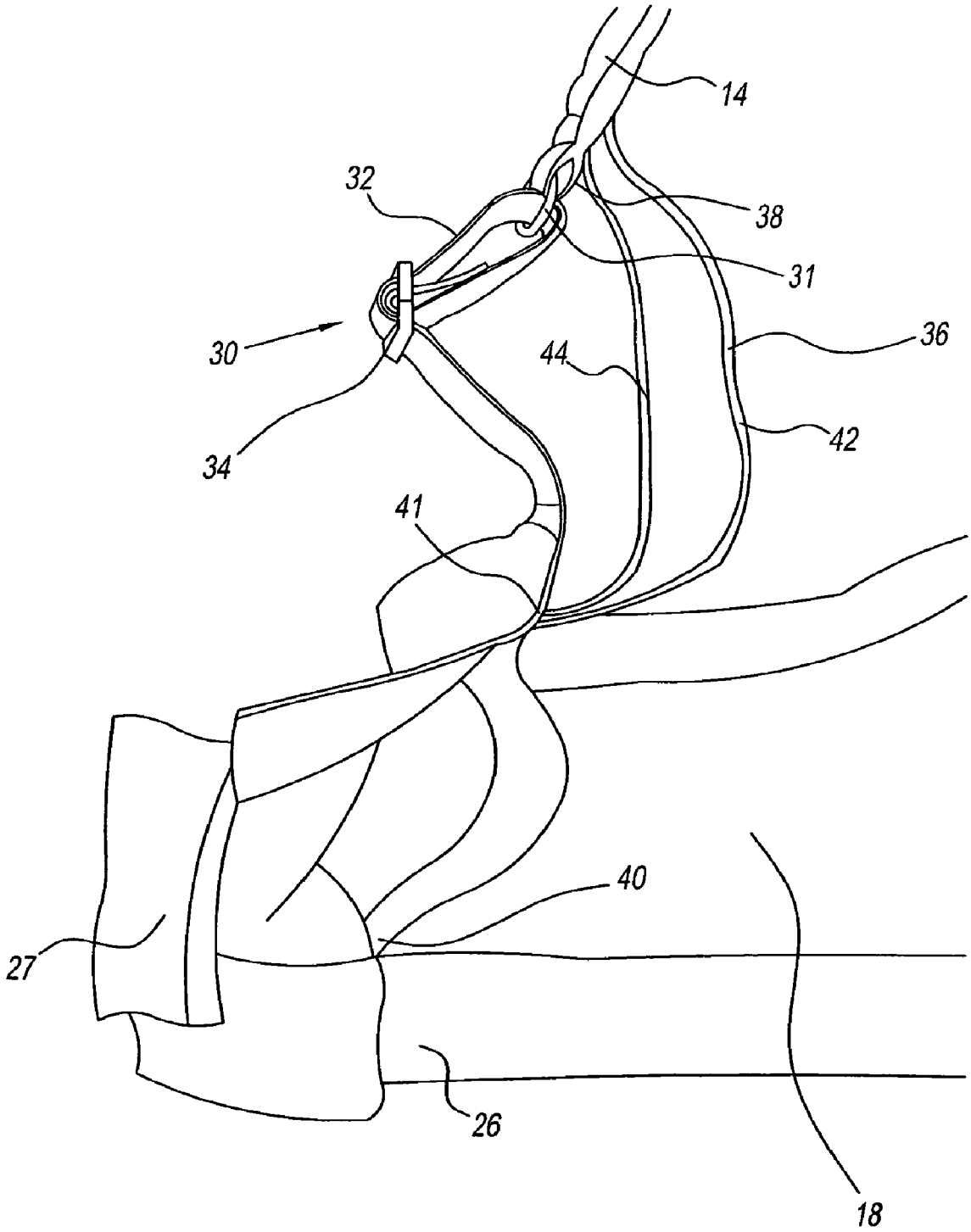
FIG. 5 is another enlarged rear view of the brassiere of FIG. 4 with the second front strap and the second cushioning device.

Referring now to FIG. 5, there is shown a rear close up view of the second front strap 14 of the brassiere 10. The brassiere has a first cushioning device 36. The first cushioning device 36 is preferably made from an elastic cushioning material. The elastic cushioning material of the first cushioning device 36 is preferably generally rectangular in shape and is an elastic strap that has one or more elastic fibers such as Spandex, Lycra, Dorlastan, or any combinations thereof. Alternatively, the first cushioning device 36 may be a composite material, or can be made from cotton. The first cushioning device 36 has a first side 38, a second side 40 opposite the first side, a wearer facing side 42 shown in FIG. 7, and a wearer opposing side 44 opposite the wearer facing side shown in FIG. 6. Most preferably, the first cushioning device 36, or the wearer opposing side 44, blocks the strap assembly 30 from contacting the wearer's skin at the wearer's shoulders and at the wearer's back. Preferably, the first cushioning device 36 prevents the first front strap 12, the second front strap 14, and the strap assembly 30 from contacting the wearer's skin directly and instead permits the wearer's skin to contact a smooth surface of the first cushioning device 36. In one alternative embodiment of the present invention, the first cushioning device 36 may have a cushioning member with an interior filled with a cushioning material such as a padding or a gel.

Although being shown as disposed on the first front strap 12 and the second front strap 14, the cushioning device 36 is not limited to the first front strap and the second front strap. Alternatively, multiple cushioning devices may be used and are within the scope of the present invention. The first cushioning device 36, a second cushioning device and an additional third and fourth cushioning device 36 may be connected also to each of the first front strap 12, the second front strap 14, or any other strap to block any strap assembly 30 or relatively hard material from contacting the wearer's skin to impart comfort to the wearer. Still further, the first cushioning device 36 may have a coating (not shown) being disposed thereon. The coating may be a wicking material, a moisture management material, a topical finish, or any combinations thereof.

The first cushioning device 36 preferably has a width that is greater than a width of all of the first front strap 12, the ring 31, the slide 34, and the strap assembly 30. One skilled in the art should appreciate that the first cushioning device 36 of the present invention is not limited to a rear closure brassiere. The present invention can be expanded to front closure brassieres having a hook and eye assembly 28 in a front opening thereof. Alternatively, the present invention can be expanded to front closure brassieres having plastic or metal clasps, or a metal hook in a front opening thereof The first side 38 of the first cushioning device 36 is preferably connected to the second front strap 14. The second side 40 of the first cushioning device 36 is preferable connected and secured underneath a bottom band elastic adjacent to the second rear back panel 26. The first cushioning device 36 is preferably disposed between the strap assembly 30, and the wearer to protect the wearer's skin. The first cushioning device 36 is preferably further anchored to the body 11 at a predetermined location 41 between the first side 38 and the second side 40.

Figure 6:
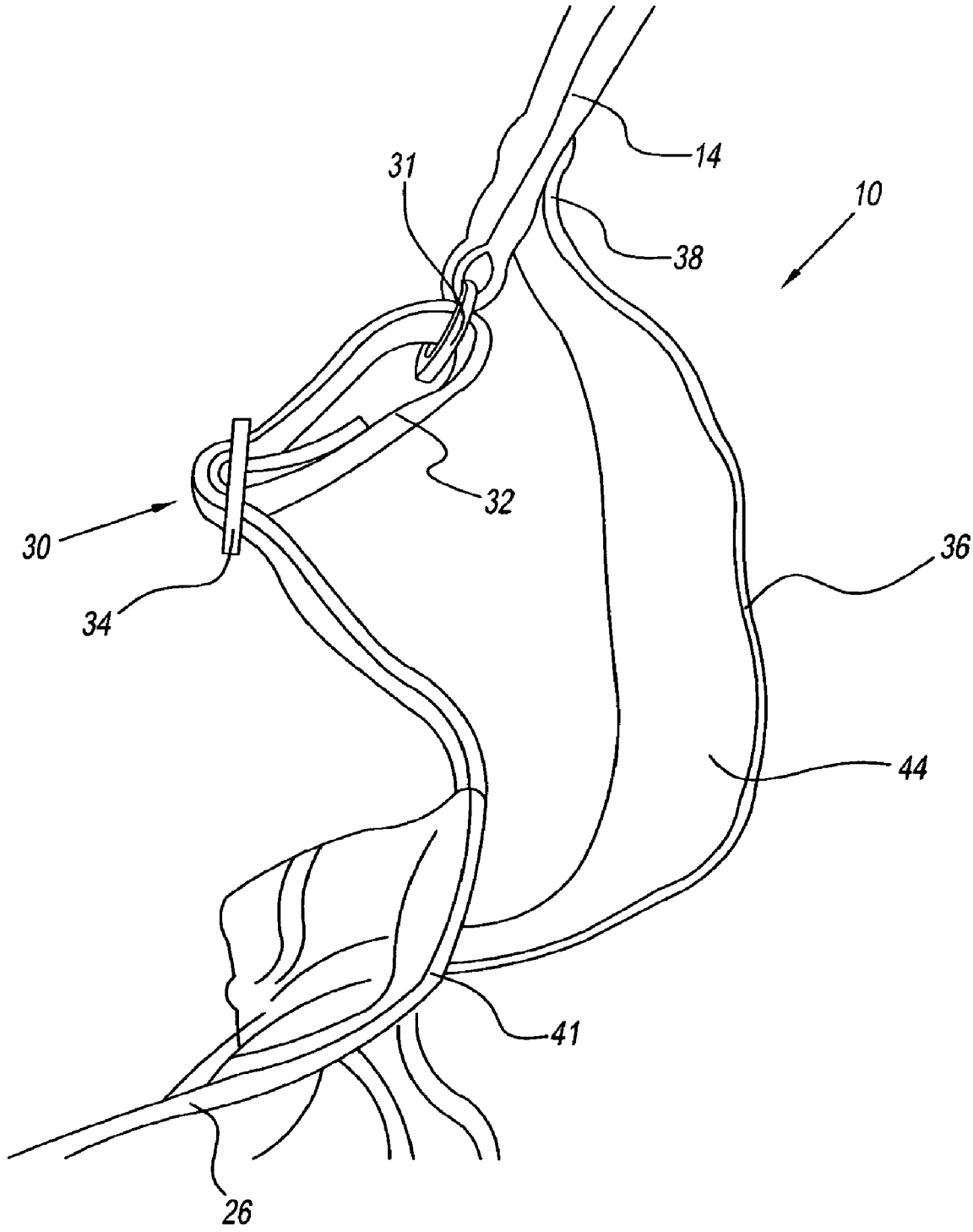
FIG. 6 is side view of the second cushioning device of FIG. 5.

Referring to FIG. 6, there is shown the wearer opposing side 44 of the first cushioning device 36 of the present invention connected to the second front strap 14. The first cushioning device 36 is preferably anchored to the second front strap 14 at the predetermined location 41 so as to prevent the first cushioning device from becoming intertwined relative to both the second front strap and/or the strap assembly 30. Instead, the first cushioning device 36 remains in position between both the slide 34, and the ring 31 and the wearer to prevent the slide, and the ring from contacting the wearer.

Figure 7:
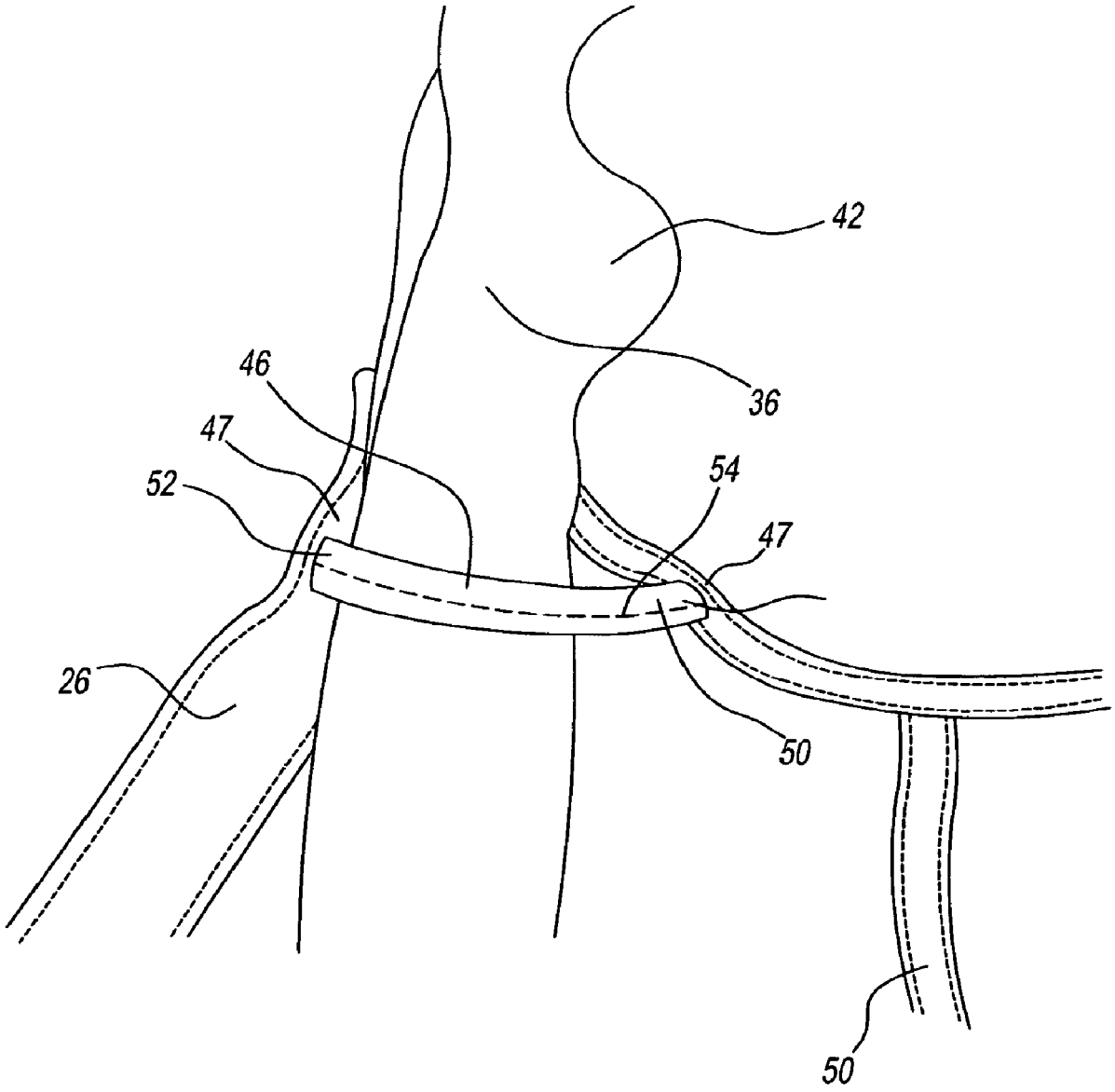
FIG. 7 is rear view of the second front strap of the brassiere of FIG. 5 showing the second cushioning device with the first position stabilizing tab.

Referring to FIG. 7, the first cushioning device 36 preferably has a first position stabilizing tab 46. The first position stabilizing tab 46 is preferably a longitudinal member. The first position stabilizing tab 46 forms a loop structure having a space. Preferably, the first cushioning device 36 fits through the space. The first position stabilizing tab 46 is connected at two or more points between the second side panel 18 and the second rear back panel 26. One skilled in the art should appreciate that the first position stabilizing tab 46 is not limited to this location and could be connected at two points to one uniform fabric structure that encircles the torso of the wearer. Preferably, the first position stabilizing tab 46 is connected to a back facing elastic 47 disposed on an inner surface of the body 11 of the brassiere 10. The first position stabilizing tab 46 is preferably made from a number of fibers with at least some of the fibers being elastic fibers. The first position stabilizing tab 46 has a first flat side 50 and a second slanted side 52 opposite the first flat side. The first position stabilizing tab 46 preferably holds the first cushioning device 36 in position relative to the slide 34, the ring 31 or the strap assembly 30. The first position stabilizing tab 46 is connected by two stitching operations 54, and is preferably disposed in a substantially perpendicular manner relative to an orientation of the first cushioning device 36. Alternatively, depending upon one or more design and style considerations of the brassiere 10 an angle of the stitching operations relative to an orientation of the first cushioning device 36 could change.

Figure 8:
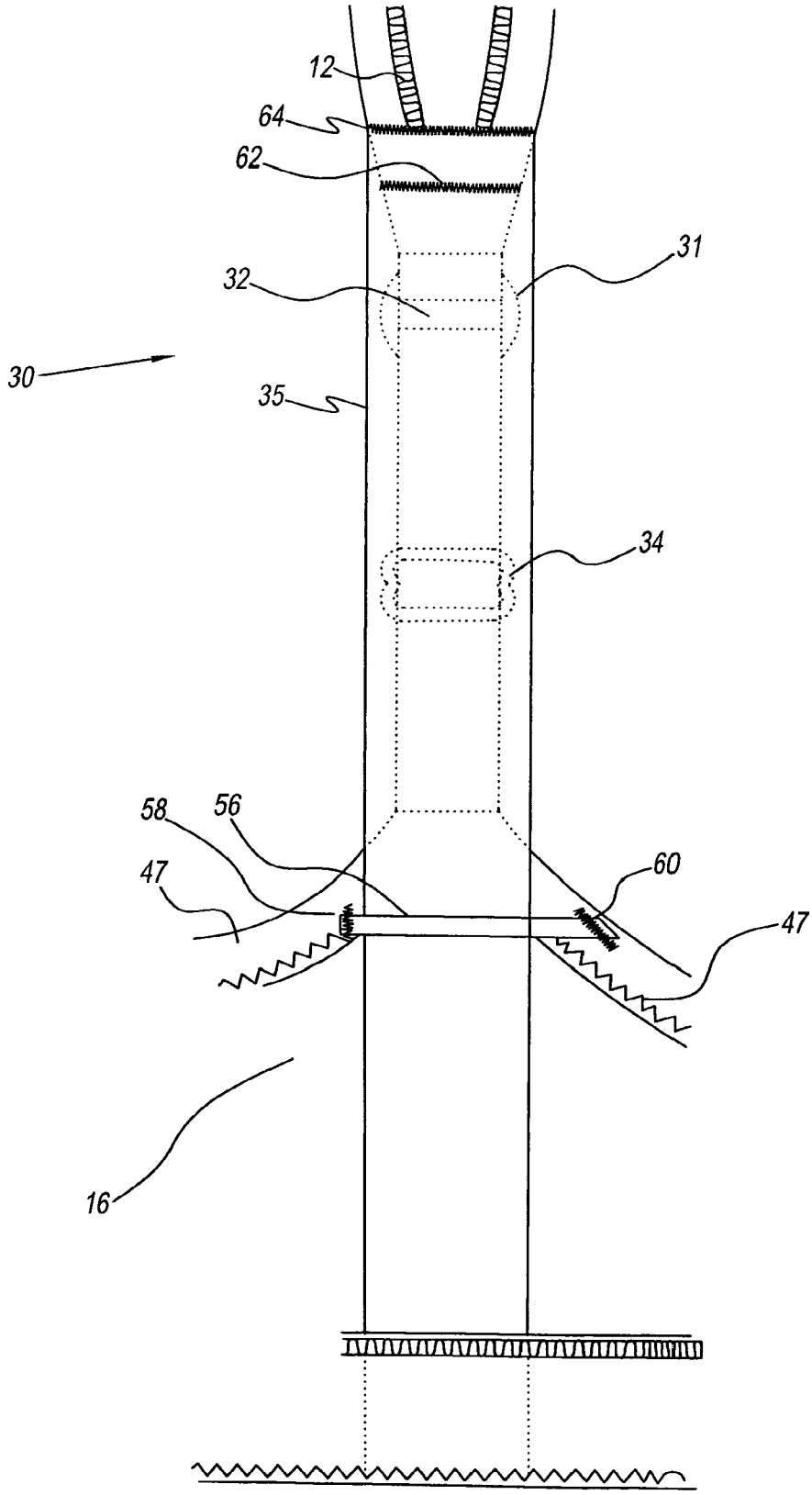
FIG. 8 is rear view of the first front strap of the brassiere of FIG. 1 showing the first cushioning device with the second position stabilizing tab.

Referring to FIG. 8, there is shown the first front strap 12 of the brassiere 10 with a second cushioning device 35. The second cushioning device 35 preferably has a second position stabilizing tab 56. The second position stabilizing tab 56 preferably anchors the second cushioning device 35 in position relative to the slide 34 and the ring 31 of the first front strap 12. The second position stabilizing tab 56 forms a loop with a space and the second cushioning device 35 fits therethrough. The second position stabilizing tab 56 is connected by a second stitching operation 58 to the back facing elastic 47 that is connected to the first side panel 16. The second position stabilizing tab 56 is connected to the back facing elastic 47 that is connected on the opposite side by a second stitching operation 60. The second position stabilizing tab 56 is preferably disposed in a substantially perpendicular manner relative to an orientation of the second cushioning device 35. The second cushioning device 35 is connected to both the first front strap 12 by a first line of stitching 62 and by a second line of stitching 64 opposite the second position stabilizing tab 56.

The second cushioning device 35 is concealed behind the first side panel 16 of the brassiere 10 to prevent the second cushioning device from being seen by the user. In this manner, the second cushioning device 35 does not become intertwined with the first front strap 12.

In another exemplary embodiment of the present invention, the brassiere 10 may be formed without any first position stabilizing tab 46 and second position stabilizing tab 56. In this embodiment, the first cushioning device 36 and the second cushioning device 35 instead are directly connected by stitching to the back facing elastic 47 on the body 11 of the brassiere 10. In this manner, both the first cushioning device 36 and the second cushioning device 35 do not become intertwined with any of the first front strap 12 or the second front strap 14.

It should be understood that the foregoing description is only illustrative of the present invention. Various alternatives and modifications can be devised by those skilled in the art without departing from the present invention. Accordingly, the present invention is intended to embrace all such alternatives, modifications and variances.

What is claimed is:

1. A brassiere for protecting a wearer's skin, the brassiere comprising:

a pair of breast cups;

a first side panel and a second side panel each being connected to a different one of said pair of breast cups;

a pair of straps;

a length adjustment device being disposed on each of said straps; and a pad disposed beneath each length adjustment device, wherein each of said pads cushions the wearer's skin from said length adjustment device, and wherein each of said pads has a position stabilizing tab for preventing each of said pads from sliding relative to each of said straps.

2. The brassiere of claim 1, wherein each of said position stabilizing tabs forms a loop having a space, each of said pads having a cushioning member fitting through said space, wherein each of said cushioning members is between the wearer's skin and each of said length adjustment devices.

3. The brassiere of claim 2, wherein each of said cushioning members is a substantially rectangular shaped elastic strap.

4. The brassiere of claim 3, wherein each of said position stabilizing tabs is a longitudinal member.

5. The brassiere of claim 4, wherein each of said position stabilizing tabs overlaps a portion of each of said cushioning members.

6. The brassiere of claim 5, wherein each of said longitudinal members are arranged in a substantially perpendicular manner relative to an orientation to each of said cushioning members.

7. The brassiere of claim 6, wherein each of said longitudinal members is connected at a plurality of points on an inner surface of the brassiere, and wherein each of said longitudinal members is anchored on said inner surface.

8. The brassiere of claim 7, wherein each of said longitudinal members is connected to said inner surface by stitching.

9. The brassiere of claim 1, wherein each of said length adjustment devices is a strap assembly having a slide, a ring, and a looped portion, and wherein said strap is an elastic strap.

10. The brassiere of claim 1, wherein each of said pads has a width for concealing each of said length adjustment devices.

11. The brassiere of claim 1, wherein each of said pads has a cushioning strap.

12. The brassiere of claim 11, wherein each of said cushioning straps is connected to each of said straps.

13. The brassiere of claim 12, wherein each of said cushioning straps is connected to each of said straps by a line of stitching, each of said lines of stitching being disposed substantially perpendicular to each of said cushioning straps.

14. The brassiere of claim 12, wherein each of said cushioning straps is connected to each of said straps by a plurality of lines of stitching, each of said plurality of lines of stitching being disposed substantially parallel to one another and substantially perpendicular to each of said cushioning straps.

15. A brassiere for protecting a wearer's shoulder, the brassiere comprising:

a pair of breast cups;

a first side panel and a second side panel each being connected to a different one of said pair of breast cups;

a first elastic strap being connected to said first side panel and a second elastic strap being connected to said second side panel;

a length adjustment device being connected to each of said first and second elastic straps; and a pad disposed beneath each of said length adjustment devices and having a wearer facing side, a first side and a second side, each of said wearer facing sides cushioning the wearer's back from a hardness of each of said length adjustment devices, wherein each of said pads has a stabilizing tab for preventing each of said pads from sliding relative to each of said first and second elastic straps, each of the stabilizing tabs being substantially perpendicular to each of said pads.

16. The brassiere of claim 15, wherein each of said first elastic straps is connected to each of said pads by a plurality of first lines of stitching each perpendicular to each of said pads, and wherein each of said pads is partly concealed in the brassiere.

17. A brassiere for protecting a wearer's shoulders, the brassiere comprising:

a pair of breast cups;

a first side panel and a second side panel each being connected to a different one of said pair of breast cups;

a pair of shoulder straps being connected to said side panels and a rear of the brassiere;

an adjustment device being connected to each of said shoulder straps; and a pad disposed beneath each of said adjustment devices, wherein each of said pads cushions the wearer's shoulder from each of said length adjustment devices, and wherein each of said pads has a position stabilizing tab for preventing each of said pads from sliding relative to each of said shoulder straps.

18. The brassiere of claim 17, wherein each of said cushioning devices is a substantially rectangular shaped elastic strap.

19. The brassiere of claim 18, wherein each of said position stabilizing tabs is a longitudinal member connected to a side panel by a first stitching operation, and connected to a back facing elastic on an inner side of the brassiere by a second stitching operation.

20. The brassiere of claim 19, wherein each of said longitudinal members is arranged in a substantially perpendicular manner relative to an orientation of each of said pads.

21. The brassiere of claim 18, wherein each of said longitudinal members is anchored on one of said first or second side panels.

22. The brassiere of claim 21, wherein each of said longitudinal members is connected to one of said first or second side panels by stitching.

23. The brassiere of claim 17, wherein each of said length adjustment devices is a strap assembly having a ring, a slide, and a looped portion, and wherein each of said shoulder straps is an elastic strap.

24. The brassiere of claim 17, wherein each of said pads substantially conceals each of said length adjustment devices.

25. A garment for protecting a wearer's skin, the garment comprising:

a strap being connected to a body portion of the garment;

a device for imparting a property to said strap, said property being selected from the group consisting of a length adjustment of said strap, a connection of said strap to another portion of said strap, a connection of said strap to said body portion, and combinations thereof, said device having a first hardness harder than a second hardness of both the body portion and said strap; and a pad, wherein said pad cushions the wearer from said first hardness, and wherein said pad has a position stabilizing tab for preventing said pad from sliding relative to said strap.

* * * * *